United States Patent [19]

Brown

[11] Patent Number: 5,000,143

[45] Date of Patent: Mar. 19, 1991

[54] ENGINE LUBRICATION SYSTEM WITH SHARED OIL FILTER

[75] Inventor: M. Wayne Brown, Sacramento, Calif.

[73] Assignee: Lubrication Research, Inc., Carlsbad, Calif.

[21] Appl. No.: 494,126

[22] Filed: Mar. 15, 1990

[51] Int. Cl.[5] ..... F01M 1/00

[52] U.S. Cl. ..... 123/196 S; 184/6.18

[58] Field of Search ..... 123/196 S, 196 R, 198 C; 210/232; 184/6.18

[56] References Cited

U.S. PATENT DOCUMENTS

| | | | |
|---|---|---|---|
| 1,289,903 | 12/1918 | Pogue | 184/6 |
| 1,926,801 | 9/1933 | Christian | 184/6 |
| 2,102,514 | 12/1937 | Clarkson | 123/196 S |
| 2,110,662 | 3/1938 | Fisher | 123/196 S |
| 2,122,049 | 6/1938 | Stark | 123/196 S |
| 2,178,642 | 11/1939 | Ott | 184/6 |
| 2,178,756 | 11/1939 | Joost | 123/196 S |
| 2,273,888 | 2/1942 | Paulsen | 123/196 S |
| 2,393,833 | 1/1946 | Steiner | 184/6 |
| 2,413,069 | 12/1946 | Reagan | 123/196 S |
| 4,453,511 | 6/1984 | Pluequet | 123/196 S |
| 4,458,644 | 7/1984 | Papst | 123/196 S |
| 4,502,431 | 3/1985 | Lulich | 123/179 A |
| 4,513,705 | 4/1985 | Evans | 123/196 S |
| 4,531,485 | 7/1985 | Murther | 123/196 S |
| 4,628,877 | 12/1986 | Sundles et al. | 123/196 S |
| 4,648,363 | 3/1987 | Kronich | 123/196 S |

FOREIGN PATENT DOCUMENTS

| | | |
|---|---|---|
| 1943425 | 7/1982 | U.S.S.R. . |
| 266614 | 3/1927 | United Kingdom . |

*Primary Examiner*—E. Rollins Cross

*Attorney, Agent, or Firm*—Knobbe, Martens, Olson & Bear

[57] ABSTRACT

A lubrication system for internal combustion engines including an electrically operated oil pump, a conduit, an electrical time-delay relay, a one-way valve and a pump bypass. Another conduit and electrical time-delay relay may be used with turbocharged engines. The lubrication system pressurizes engine oil when the mechanical oil pump is not fully operational. In a preferred embodiment, the lubrication system has an oil filter adapter which includes a one-way check valve.

14 Claims, 2 Drawing Sheets

FIG. 1
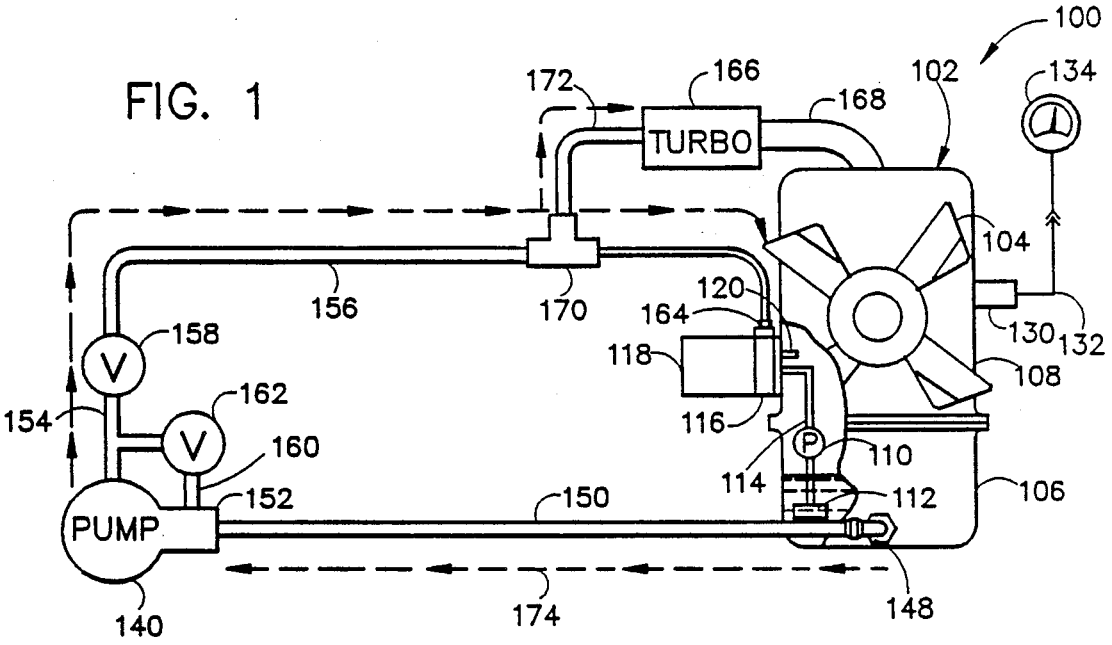
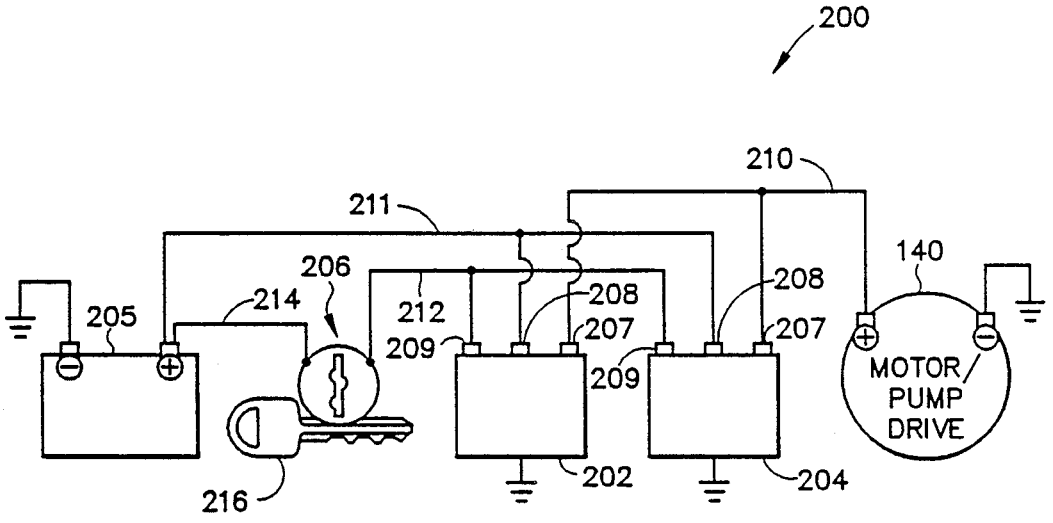
FIG. 2

ENGINE LUBRICATION SYSTEM WITH SHARED OIL FILTER

BACKGROUND OF THE INVENTION

1. Field of the Invention

The present invention generally relates to lubrication systems for internal combustion engines and, more particularly, is concerned with lubrication systems providing pressurized oil to the engine when a mechanical oil pump is not fully operational.

2. Description of the Prior Art

Internal combustion engines, principally of the gasoline fueled varieties, have been the primary motive devices behind automobiles for over eighty years. During this time, the automobile engine has benefited from improvements too numerous to list. However, although at first glance a modern reciprocating engine would appear radically different from an early engine, such as the engine installed in a Ford Model T, once stripped down to their cores the two engines would have nearly identical components. In all internal combustion engines, fundamental moving components such as pistons, connecting rods, camshafts, crankshafts, valves and so on, must contend with frictional forces.

Engine friction has historically been mitigated by a lubrication system which includes a mechanical oil pump to force-feed oil throughout the engine. Nevertheless, engine wear, represented by such things as worn piston rings and leaky valves, will generally limit the life span of an engine. At some point, if the wear on an engine is left unchecked, the engine will cease functioning completely. The life of an engine can be prolonged, however, if certain extraordinary periods of wear are alleviated by the lubrication system. These periods of wear are not normally serviced by the mechanical oil pump.

The most critical time for engine wear occurs between the initiation of starter motor cranking and the pressurization of the engine oil circuit by the mechanical oil pump. In summary, engine wear is most extensive during periods when frictional components are not being adequately lubricated, i.e., when the oil pressure induced by the mechanical oil pump is beneath some nominal level.

Frictional damage also arises inside turbochargers. An exhaust driven turbocharger contains a rotor, driven by exhaust gas, which spins at speeds exceeding 30,000 r.p.m. This figure translates into the equivalent of 500 revolutions per second by the turbocharger rotor. The rotor spins on a shaft, which is indirectly connected to the rotor by a center bearing. The center bearing serves to absorb the severe frictional forces caused by the tremendous angular velocities of the spinning rotor.

After the engine ignition is turned off, the rotor continues to spin at a high speed without the benefit of engine oil pressure. This period of time is appropriately referred to as "spin-down". Besides the loss of pressure at the center bearing during spin-down, the bearing also loses a medium of heat exchange. The oil on the center bearing will normally transfer the heat which has been absorbed by the bearing from the exhaust gases carried by the turbocharger rotor. However, during spin-down the oil remaining around the bearing surface will burn, depositing an abrasive coke layer around the surface and thereby causing premature wear. Since turbocharger life is primarily measured by the condition of the center bearing, the life of the turbocharger can be extended if the center bearing is provided adequate oil pressure during spin-down.

Clearly, because there is a significant payback in engine life, many people familiar with lubrication system technology have been actively working to prolong engine and turbocharger life by minimizing the wear on frictional components during the periods discussed above. The typical approach to pressurizing the lubrication system during these periods is to add an external lubrication circuit to the engine. The external circuit includes an electrically operated oil pump, which operates during specific periods when the mechanical oil pump is not fully operational. The patents issued to Sundles, et al. (U.S. Pat. No. 4,628,877) and Murther (U.S. Pat. No. 4,531,485) are two representative examples of such lubrication systems incorporating electrically operated oil pumps.

Sundles, et al., discloses an electrically operated oil pump, external to the engine, having an inlet connected by a suction hose to the oil sump of the engine. At the outlet of the electric pump, a one-way check valve prevents pressure leakage between the internal lubrication circuit and the external lubrication circuit. A bypass valve connects the electric pump outlet to the pump inlet to prevent pump pressure overload when the pump is running and the one-way check valve is closed. Two conduits connect the outlet of the one-way check valve to the engine and the turbocharger. A first time-delay relay connected to the ignition system energizes the electric pump after the ignition is turned on, thus lubricating the engine during cranking. A second time-delay relay energizes the electric pump after the ignition is turned off, thus lubricating the turbocharger during spin-down.

Sundles, et al. exemplifies one of a number of related lubrication systems which perform satisfactorily, but also for which several areas of improvement have been identified. In such prior technology lubrication systems, oil from the electrically operated pump enters the engine by way of a T-fitting placed between the engine and a conventional oil pressure sender. Typically, sender units are not readily accessible, and even where a work area for a unit is convenient, there are other considerations in choosing not to use the sender unit location as an oil inlet.

For instance, since there is a large variety of sender unit threadings, threadings between the sender unit and the T-fitting may not match. In addition, near the sender unit location on the engine, the space for attaching the oil conduit and the fittings, which form a part of the external lubrication circuit, is usually limited. More importantly, because oil sender units are usually located at the midpoint of engine oil galleries, oil disbursement from such a location to the larger, lower oil galleries is not as thorough as the oil distribution made by the mechanical oil pump located near the oil filter at the bottom of the engine.

In addition, the T-fitting causes oil to flow in two directions, often forcing air down into crankshaft main and connecting rod bearings. The resulting oil starvation at these critical components can produce complete engine breakdown. Further, when oil is directed into the engine at the oil sender location, oil for the external lubrication circuit is pumped out of the oil sump and back into the engine without filtration, thereby depositing unwanted grit into the upper engine. As a final shortcoming to be noted, if the oil conduit between the electric pump outlet and the engine is disconnected or broken while the engine is running, engine oil is immediately evacuated from the engine through the T-fitting thereby causing the engine to seize.

As another example of a lubrication system having an external lubrication circuit, Murther shows an electrical oil pump running in parallel with the mechanical oil pump. Oil enters the mechanical and electrical oil pumps through an oil outlet pipe connected to the oil sump. A one-way check valve at the outlet of each pump prevents oil from back-flowing between the pumps. The check valve outlets are joined and enter the oil filter through a single conduit. Oil from the oil filter returns to the engine though an oil inlet pipe.

The Murther lubrication system has at least three serious disadvantages. First, the Murther electrical oil pump is timed to pump oil only after the starter motor is activated, and thus, the lubrication system is not fully pressurized at the beginning of the critical cranking period. Second, the oil filter used in Murther has a single inlet into which oil is pumped from the mechanical and electrical oil pumps. Such a single inlet is an awkward means of connecting the oil filter to the two oil pumps, since the configuration shown in Murther either requires a special type of oil filter distinct from the standard "spin-on" oil filter, or it requires both the mechanical and the electrical pumps to be located inside the engine. Third, the Murther invention does not provide for oiling a turbocharger center bearing during spin-down.

Consequently, a need exists for still further improvement in engine and turbocharger lubrication systems, particularly in routing and filtering oil pumped from the oil sump into the engine block by an electrically operated oil pump.

SUMMARY OF THE INVENTION

The present invention generally provides a lubrication system for minimizing frictional wear inside of a conventional internal combustion engine. In such an engine, a mechanical oil pump supplies oil to an oil filter before disbursing oil to the oil galleries of the engine. In addition, the present system for engine lubrication comprises an electrically operated oil pump having an inlet which receives oil from the engine oil sump, and having a pressurized oil outlet. The oil pump outlet feeds oil into a first conduit which is connected at its other end to an oil filter adapter. The adapter has two oil inlets. One inlet receives oil from the electrically operated oil pump, and the second inlet receives oil from the mechanical oil pump. A one-way check valve in the oil filter adapter prevents oil spillage when the first conduit is disconnected or broken while the engine is running, and it prevents the back-flow of oil from the mechanical oil pump to the electrically operated oil pump when the latter pump is not operating.

Another one-way valve near the outlet of the electrically operated pump prevents the back-flow of oil from the engine into the pressurized oil outlet of the electrically operated pump. A bypass valve connects the pressurized oil outlet of the electrically operated oil pump to the pump inlet. Thus, when the pump is running, and the one-way valve is closed or clogged, the pressure inside the electrically operated oil pump is relieved by the bypass valve.

A first electrical time-delay relay controls the electrically operated oil pump as follows: when the engine ignition is turned on, the electrically operated oil pump is operated for a predetermined time, preferably until the mechanical oil pump can maintain a nominal operating oil pressure.

The electrically operated oil pump, where applicable, also pressurizes an engine turbocharger during turbocharger spin-down, including the period in which the center bearing is cooling. This is accomplished by including a second conduit from the outlet of the electrically operated pump to the oil inlet of the turbocharger. A second electrical time-delay relay activates the electrically operated oil pump for a predetermined time period after the ignition is turned off, preferably until the turbocharger rotor is no longer moving or the center bearing is cooled below the critical burn point of the lubricating oil.

Accordingly, the present lubrication system introduces filtered oil to the engine through a dual-inlet oil filter adapter, during periods when the mechanical oil pump is not fully operational. Moreover, the present lubrication system allows electrically pumped oil to enter the engine at the beginning of the engine lubrication circuit, thereby improving the oiling of critical moving components located near oil galleries having larger bores, at the bottom of the engine. The oil filter adapter is very easy to install, and it neatly "sandwiches" between the engine block and the oil filter. Further, the adapter can optionally include an internal check valve which prevents oil from being evacuated from the engine if either of the two inlet conduits are disconnected or broken while the engine is running.

These and other objects and features of the present invention will become more fully apparent from the following description and appended claims taken in conjunction with the accompanying drawings.

BRIEF DESCRIPTION OF THE DRAWINGS

FIG. 1 is a schematic diagram illustrating an engine with a portion cut away to show the mechanical elements of an engine lubrication system in one presently preferred embodiment of the invention.

FIG. 2 is a schematic diagram of an electrical circuit which controls the mechanical elements of the engine lubrication system shown in FIG. 1.

DESCRIPTION OF THE PREFERRED EMBODIMENTS

Figure 3:
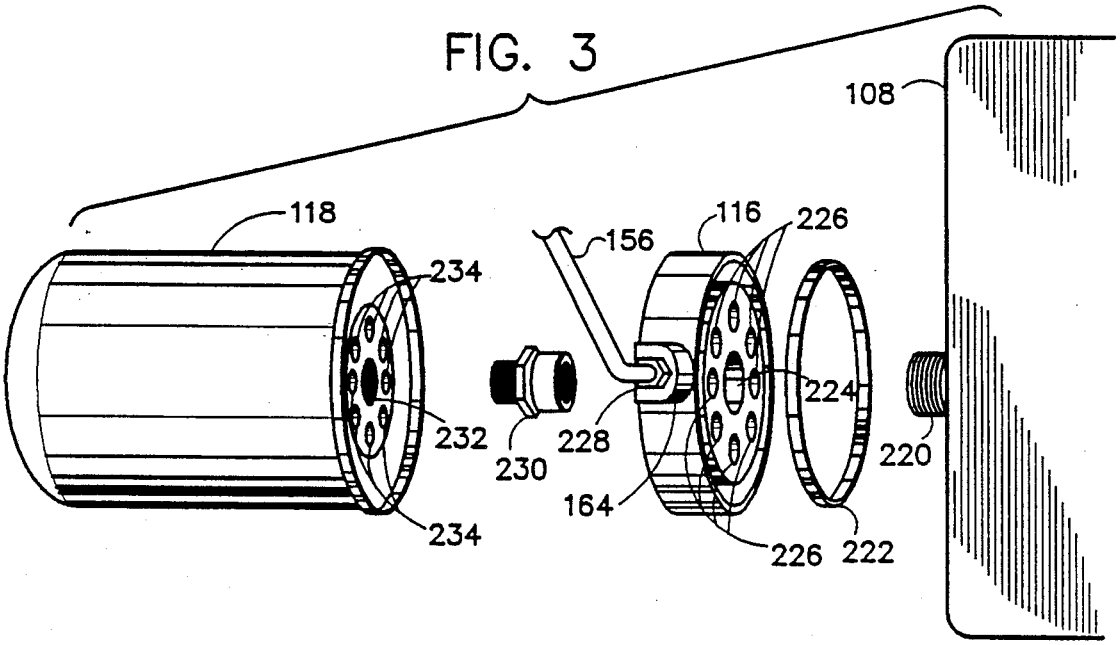
FIG. 3 is an exploded perspective view of one preferred embodiment of an oil filter assembly used in the present lubrication system.

Reference is now made to the drawings wherein like parts are designated with like numerals throughout.

Referring to FIG. 1, the present invention includes a lubrication system generally indicated at 100 for an internal combustion engine generally indicated at 102. The engine 102 may be a reciprocating engine, a rotary engine, or any other like engine which burns combustible fuels and generates power in conformance with thermodynamic principles. The heat produced by the operation of the engine 102 is cooled in part by a fan 104 forcing air through a radiator (not shown).

While the engine is running, a set of moving components (not shown) located inside the engine including, for example, a crankshaft, is lubricated by sending pressurized oil though a series of oil galleries (not shown)

located throughout the interior of the engine 102. A quantity of oil is stored in an oil sump 106, or oil pan, located at the base of the engine 102. Oil enters an engine long block 108 by being pumped out of the oil sump 106.

A mechanical oil pump 110 is attached to the engine block 108. The oil pump 110 sucks in oil from the oil sump 106 through an oil pickup 112 having a conduit connected to the oil pump 110. The oil pump 110 then force-feeds oil through an oil channel 114 in the engine block 108, and from there, through an inlet in an oil filter adapter 116 and further into an oil filter 118. The oil filter adapter 116 will be described in detail hereinafter with reference to FIGS. 3 and 4.

The pressurized and filtered oil exits the oil filter 118 through an oil filter outlet 120. The oil exiting from the oil filter outlet 120 is disbursed throughout the galleries of the engine block 108 where it coats and lubricates the internal moving parts of the engine 102. After lubricating the moving parts, the oil drips back down into the oil sump 106 where it begins the cycle anew.

Engine oil pressure is monitored by an oil sender unit 130 which is usually screwed into an aperture (not shown) in the engine block 108. The oil sender unit 130 converts measured oil pressure into an electrical signal which is transmitted by a current carrying wire 132 to an oil pressure gauge 134. The oil sender unit 130 is positioned at a mid-point in the engine lubrication circuit so that an average engine oil pressure can be obtained. It is at the oil sender unit 130 where some prior lubrication systems, having an external lubrication circuit, have fed oil back into the engine 102. In those systems, as discussed above, a T-fitting (not shown) would be placed between the engine 102 and the oil sender unit 130, and oil from the external lubrication circuit would be directed into the engine 102 through the T-fitting.

The components described thus far are conventional components found in most lubrication systems for internal combustion engines, and the operation of such systems is a well known technology. The mechanical oil pump 110, shown in FIG. 1, is most often driven by a gear on a camshaft or crankshaft (not shown) inside of the engine 102 which rotates at normal engine speeds only after the engine 102 is started. Prior to engine cranking by an electric starter (not shown), the oil pressure gauge 134 will indicate an oil pressure of zero pounds per square inch (0 psi). On some occasions, during engine cranking by the starter, the oil pressure inside the engine 102 rises somewhat, but the largest quantity of oil in the engine 102 still remains in the oil sump 106 and, consequently, very little oil gets to the moving components inside of the engine 102. Thus, during this critical cranking period, and a few seconds after ignition or starting, the moving engine components are subjected to excessive frictional forces which tend to shorten the life of the engine 102. Such frictional damage to the engine 102 can become even more apparent in cold weather when the thickness of the oil restricts fluid flow.

To remedy the oil starvation problem, the lubrication system 100, shown in FIG. 1, includes an electrically operated oil pump 140 such as, for example, one of the pumps manufactured by Aluminum Diecasting Corporation of Miraloma, Calif. which pressurizes oil independent of a running engine. The electrically operated oil pump 140 is operated during engine pre-startup to provide the engine 102 with oil pressure before the mechanical oil pump 110 can maintain a nominal oil pressure.

The circuit of electrically pumped oil begins inside the oil sump 106 where oil is sucked through an oil sump fitting 148. The oil sump fitting 148 connects the oil sump 106 to a conduit 150. The conduit 150 conducts the oil into a pump inlet 152 located on the electrically operated oil pump 140. Pressurized oil is pumped through a pump outlet 154 of the oil pump 140.

The pump outlet 154 is connected to a first outlet conduit 156 by way of a one-way check valve 158. The oneway check valve 158 is of a conventional type which is closed when the electrically operated pump 140 is not active, but opens up when pressurized oil is available in the pump outlet 154. Thus, oil in the conduit 156 is prevented from back-flowing out of the engine 102 and into the pump 140.

The electrically operated oil pump 140 also includes a bypass mechanism comprising a bypass conduit 160 and a pressure relief valve 162. The bypass mechanism allows pressurized oil to flow directly from the pump outlet 154 to the pump inlet 152 at predetermined high pressures. Such predetermined high pressures are generated if the one-way valve 158 clogs and the oil pump 140 is active. In a typical application, for example, the pump 140 provides a maximum output pressure of around 100 psi, and the pressure relief valve operates at around 50 to 70 psi. The schematic representation of the bypass mechanism shown in FIG. 1 is included only as an aid to understanding the operation of the bypass mechanism, since the bypass mechanism is typically integrated into the pump 140.

The other end of the first outlet conduit 156 is inserted into an adapter inlet 164 of the oil filter adapter 116. From this point, the pressurized oil enters the oil filter 118 and the filtered oil is dispersed through the outlet 120 into the engine internals by the oil galleries.

For turbocharged engines, the electrically operated oil pump 140 may also be operated after the engine 102 is turned off. Many modern engines include a turbocharger unit 166 such as the one shown in FIG. 1. A duct 168 connects the outlet of the turbocharger 166 to a carburetor or fuel injection unit (not shown) as would also be found on normally aspirated engines. The turbocharger 166 includes a rotor (not shown) which is made to spin by exhaust gases released from the engine 102, and which are fed into a turbocharger exhaust inlet (not shown). The rotor introduces a blast of air into the engine 102, accordingly increasing the air/fuel mixture delivered to the combustion chambers of the engine 102, thereby causing the engine 102 to generate more power.

The turbocharger rotor spins on a center bearing (not shown) which absorbs the high frictional forces created by the rotor spinning on a shaft (not shown). When the engine 102 is turned off, the turbocharger rotor continues to spin during a "spin-down" period and experiences a tremendous increase in heat. While the turbocharger motor is spinning down, there is no oil pressure inside the turbocharger 166 and, therefore, the center bearing suffers from excessive wear and a degradation in cooling.

To avoid center bearing wear and oil burning heat during spin-down, turbocharged engines include a T-fitting 170 inserted into the first outlet conduit 156. The base of the T-fitting 170 is connected to a second outlet conduit 172 which terminates at an oil inlet (not shown) on the turbocharger 166, allowing the turbocharger center bearing to be oiled after the engine ignition is turned off. At the two periods of time discussed above, cranking and spin-down, an electrically pumped stream of oil 174 flows according to the phantom arrows shown in FIG. 1.

The operation of the lubrication system 100, illustrated in FIG. 1, can be more fully appreciated by referring to FIG. 2. FIG. 2 illustrates a pump control circuit generally indicated at 200 that controls the operation of the electrically operated pump 140. The pump 140 is electrically connected to a first and second timedelay relay 202 and 204. Also included in the pump control circuit 200 are a car battery 205 and an ignition switch 206. In the embodiment of the pump control circuit 200, shown in FIG. 2, each of the time-delay relays 202, 204 have one output terminal 207 and two input terminals 208, 209. The output terminal 207 on each of the relays 202, 204 is connected by a first wire 210 to the motor of the oil pump 140. One of the input terminals 208 on each of the relays 202, 204 is connected to the positive terminal of the battery 205 by a second wire 211. The other input terminal 209 on each of the relays 202, 204 is connected to the ignition switch 206 by a third wire 212. The ignition switch 206 is connected to the battery 205 by a fourth wire 214.

The time-delay relays 202, 204 are conventional devices, commercially available from a number of vendors. The first time-delay relay 202 allows electric current to flow from the battery 204 to the electric pump 140 for a predetermined period of time after the ignition switch 206 is turned to the "on" position by a key 216. In a typical application, for example, the relay 202 includes a timer circuit (not shown) which allows current to flow to the pump 140 for about five seconds after the ignition switch 206 is turned on. After the set time has elapsed a switch (not shown) internal to the relay 202 opens the circuit to the pump 140 thereby preventing the pump 140 from operating.

In contrast to the first relay 202, the second time-delay relay 204 functions to provide current from the battery 204 to the pump 140 for a predetermined time period after the ignition switch 206 is turned to the "off" position by the key 216. In a typical application, for example, the timing circuit in the relay 204 is set to provide current to the pump 140 for at least twenty seconds after the ignition switch 206 is turned off. At the end of the elapsed predetermined time, a switch (not shown) internal to the second time-delay relay 204 is opened, thus preventing current from the battery 204 from reaching the pump 140 and deactivating the pump 140.

Therefore, the first time-delay relay 202 is incorporated in the circuit 200 to prevent engine wear during engine cranking. The second time-delay relay 204 is provided in the pump control circuit 200 to allow oil to reach the turbocharger center bearing during turbocharger spin-down. A further discussion of the combined operation of one lubrication system and one preferred embodiment of the pump control circuit 200 is contained in the patent to Sundles, et al. (U.S. Pat. No. 4,628,877) which is hereby incorporated by reference herein. One skilled in the art will recognize that the lubrication system 100 and the control circuit 200 will generally be arranged in the engine compartment of a vehicle.

FIG. 3 illustrates in detail the configuration of the oil filter 118, the oil filter adapter 116 and the engine block 108 as shown in FIG. 1. A conventional threaded oil filter connector 220 is affixed to the engine block 108. In a standard lubrication system having no external oil pump, the oil filter connector 220 mates directly to the oil filter 118. In the present lubrication system 100, however, the adapter 116 mediates between the oil filter connector 220 and the oil filter 118.

As shown in FIG. 3, an adapter gasket 222 slides into a groove in one side of the oil filter adapter 116. The adapter includes a central outlet aperture 224 surrounded by a set of concentric inlet apertures 226. A barbed fitting 228 located on the outer surface of the adapter 116 serves to secure one end of the first outlet conduit 156 to the oil filter adapter inlet 164. One end of the barbed fitting 228 is threaded and is screwed into a threaded aperture (not shown) in the adapter 116. The other end of the barbed fitting 228 is a conventional pipe barb (not shown), which is used to retain the first outlet conduit 156.

An adapter fitting 230, shown in FIG. 3, has a female end which extends through the central outlet aperture 224 of the adapter 116 and then screws onto the oil filter connector 220. The oil filter 118 is screwed onto the male end of the adapter fitting 230 so as to align a central outlet aperture 232 with the central outlet aperture 224 of the adapter 116, and so as to align a set of concentric inlet apertures 234 in the oil filter 118 with the concentric inlet apertures 226 in the adapter 116.

In this way, oil can enter the oil filter 118 from the oil filter adapter 116 via the concentric inlet apertures 226 or the adapter inlet 164. As is more clearly shown in FIG. 4, the adapter inlet 164 empties into one of the concentric inlet apertures 226 which channels oil into the oil filter 118 via one of the oil filter inlet apertures 234. The pressurized and filtered oil flows out of the oil filter 118 through the central oil aperture 232, through the center of the adapter fitting 230, and into the engine block 108 from the oil filter connector 220.

One preferred embodiment of the oil filter adapter 116, the adapter gasket 222, and the adapter fitting 230 can be purchased as a unit from Frantz Filter Company of Stockton, Calif. However, the oil filter adapter so obtained does not include a check valve.

Figure 4:
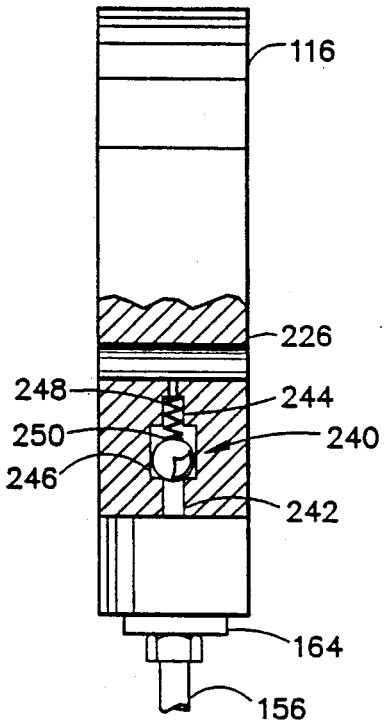
FIG. 4 is a side elevational view of the oil filter adapter having a portion cut away to show an internal check valve.

FIG. 4 illustrates how the adapter inlets 164, 226 (FIG. 3) are coordinated by an internal check valve 240 integrated into the oil filter adapter 116. The internal check value 240 is located between an oil inlet passage 242 and an oil outlet passage 244. The oil inlet passage 242 is connected to the adapter inlet 164 where oil flows in through the first outlet conduit 156 from the electrically operated pump 140 when it is active and the mechanical oil pump 110 is inactive. From the oil inlet passage 242, the oil enters a valve chamber 246.

The valve chamber 246 is constructed to have a wide opening connected to the inlet passage 242, and a narrow opening connected to the outlet passage 244. A spring 248 is seated in the narrow opening of the valve chamber 246. When the electrically operated oil pump 140 is inactive, or more generally, when the first outlet conduit 156 is not pressurized, the spring 248 holds a check ball 250 against the opening formed by the inlet passage 242, as shown in FIG. 4. Thus, the check ball 250 is prevented from moving in the valve chamber 246, and engine oil is blocked from back-flowing out the outlet passage 244 and into the inlet passage 242 of the valve chamber 246. As a result, if the first outlet conduit 156 is disconnected or broken while the engine 102 is running, engine oil will not be evacuated from the engine 102 since the internal check valve 240 will remain closed.

Some time after the electrically operated oil pump 140 begins operating, the resulting oil pressure in the first outlet conduit 156 forces oil in the outlet passage 242 against the check ball 250. The check ball 250 partially compresses the spring 248, thereby connecting the inlet passage 242 of the valve chamber 246 to the outlet passage 244 of the valve chamber 246. Therefore, when the first outlet conduit is pressurized, oil is allowed to flow from the outlet passage 244 into the oil filter 118 (FIG. 3) via one of the concentric inlet apertures 226.

Thus, it can be seen that there are many advantages to be gained from using the oil filter adapter as an entry point for oil to the engine, over the traditional method of channeling electrically pumped oil through an inlet fitting connected to the oil sender unit. First, the oil filter adapter allows oil, filtered by a standard spin-on oil filter, to be introduced to the engine, whereas an oil sender unit entry would not. Second, the oil filter adapter delivers oil to the engine at the beginning of the engine's lubrication circuit, just as the mechanical oil pump does. Third, the oil filter adapter is easily installed by removing the oil filter, screwing on the oil filter adapter with the adapter fitting and then screwing the filter onto the adapter fitting. Fourth, the oil filter adapter is designed with an internal check valve which prevents back flow of oil during periods of low pressure in the first outlet conduit.

While the above detailed description has shown, described, and pointed out, the fundamental novel features of the invention as applied to various embodiments, it will be understood that various omissions and substitutions, and changes in the form and details of the device illustrated, may be made by those skilled in the art without departing from the spirit of the invention.

I claim:

1. A system for lubrication of an internal combustion engine having an ignition, a starter motor, a battery system, a mechanical oil pump and an oil filter in fluid communication through a first inlet in said oil filter to said mechanical oil pump, comprising:

an electrically operated oil pump connected in liquid communication with an oil sump of said engine and having a pressurized oil outlet;

first conduit means for connecting said pressurized oil outlet to a second inlet of said oil filter, such that oil is communicated from said pressurized oil outlet through said second inlet and through said oil filter to a plurality of oil galleries in said engine;

first electrical time-delay relay means for connection to said electrically operated oil pump and battery system of said engine for enabling operation of said electrically operated oil pump for a first predetermined time period independently of activation of said starter motor and, after said first predetermined time period has elapsed, for disabling operation of said electrically operated oil pump;

one-way valve means in fluid communication with said first conduit means for preventing back-flow of oil into said pressurized oil outlet; and bypass means connecting said pressurized oil outlet of said electrically operated oil pump to an inlet of said electrically operated pump when said one-way valve means is closed or flow from said pressurized oil outlet is restricted.

2. A lubrication system as defined in claim 1, further comprising:

second conduit means for connecting said pressurized oil outlet of said electrically operated oil pump in liquid communication with a turbocharger attached to said engine; and second electrical time-delay relay means for enabling operation of said electrically operated oil pump for a second predetermined time period after said ignition is turned off and, after said second predetermined time period has elapsed, preventing operation of said electrically operated oil pump.

3. A lubrication system as defined in claim 1, further comprising an oil filter adapter connected to said oil filter so as to provide fluid communication therethrough between said oil filter and said oil galleries of said engine, and defining said second inlet of said oil filter.

4. A lubrication system as defined in claim 3, wherein said oil filter adapter includes a filter portion for filtering oil received through said second inlet from said electrically operated oil pump.

5. A lubrication system as defined in claim 3, wherein said one-way valve means comprises a first check valve integral to said oil filter adapter in fluid communication with said first inlet and said second inlet of said oil filter such that said first check valve is closed when said second inlet is not pressurized above a predetermined pressure.

6. A lubrication system as defined in claim 3, wherein said one-way valve means comprises:

a first check valve integral to said oil filter adapter in fluid communication with said first inlet and said second inlet of said oil filter such that said first check valve is closed when said second inlet is not pressurized above a predetermined pressure; and a second check valve interposed between said first conduit means and said second conduit means such that said second check valve is closed when said first conduit means is not pressurized above a predetermined pressure.

7. A lubrication system as defined in claim 1, wherein said bypass means allows electrically pumped oil to flow directly from said pressurized oil outlet to said oil inlet of said electrically operated oil pump in the event that oil pressure generated by said mechanical oil pump closes said one-way valve means.

8. A lubrication system as defined in claim 1, wherein said first predetermined time period exceeds about five seconds.

9. A lubrication system as defined in claim 2, wherein said second predetermined time period exceeds about twenty seconds.

10. A lubrication system as defined in claim 1, wherein said connection between said electrically operated pump and said oil sump is comprised of a third conduit means which is not connected to said mechanical oil pump such that the operation of said mechanical oil pump does not affect the oil flow to said electrically operated oil pump.

11. A sandwich adapter for internal combustion engines having an engine block, a spin-on oil filter, and an external lubrication circuit, said sandwich adapter comprising:

a housing;

means for connecting said housing to said engine block for fluid communication therebetween;

means for connecting said housing to said spin-on oil filter for fluid communication therebetween;

means for connecting said housing to said external lubrication circuit for fluid communication therebetween; and a one-way check valve integral to said housing in fluid communication with said external lubrication circuit connecting means for preventing the backflow of fluid into said external lubrication circuit.

12. A sandwich adapter as defined in claim 11, wherein said housing comprises a plurality of passageways for conducting fluid from said external lubrication circuit and said engine block to said spin-on oil filter.

13. An external lubrication circuit for internal combustion engines of the type having an ignition, a starter motor, a battery system, a mechanical oil pump and an oil filter in fluid communication through a first inlet in said oil filter to said mechanical oil pump, comprising:

an external oil pump connected in liquid communication with an oil sump of said engine and having a pressurized oil outlet;

a first conduit connected between said pressurized oil outlet and a second inlet of said oil filter;

a first time-delay circuit connected to said external oil pump for enabling said external oil pump for a first predetermined time period independently of activation of said starter motor and, after said first predetermined time period has elapsed, for disabling said external oil pump;

a one-way valve in fluid communication with said first conduit; and a bypass conduit connected between said pressurized oil outlet and an oil inlet of said external oil pump.

14. An external lubrication circuit as defined in claim 13, additionally comprising:

a second conduit connected between said pressurized oil outlet and a turbocharger mounted on said engine; and a second time-delay circuit for enabling said external oil pump for a second predetermined time period after said ignition is turned off and, after said second predetermined time period has elapsed, disabling said external oil pump.

* * * * *